United States Patent [19]

Cheng et al.

[11] Patent Number: 4,816,089

[45] Date of Patent: Mar. 28, 1989

[54] PROCESS FOR HEAT TREATING A HEAT EXCHANGER TUBE SURROUNDED BY A SUPPORT PLATE

[75] Inventors: Wenche W. Cheng; George G. Elder, both of Monroeville Boro, Pa.

[73] Assignee: Westinghouse Electric Corp., Pittsburgh, Pa.

[21] Appl. No.: 69,721

[22] Filed: Jun. 6, 1987

[51] Int. Cl.[4] ..... C21D 9/14; B23K 1/04

[52] U.S. Cl. ..... 148/127; 148/13; 148/13.1; 148/11.5 N; 148/128; 219/534; 219/535; 219/549; 219/553

[58] Field of Search ..... 148/127, 128, 13, 13.1, 148/11.5 N; 219/534, 535, 549, 553

[56] References Cited

U.S. PATENT DOCUMENTS

| | | | |
|---|---|---|---|
| 4,147,569 | 4/1979 | Reinke et al. | 148/128 |
| 4,326,897 | 4/1982 | Ruhe et al. | 148/13.1 |
| 4,512,820 | 4/1985 | Mori et al. | 148/11.5 N |
| 4,523,177 | 6/1985 | Driggers | 338/308 |
| 4,539,987 | 9/1985 | Nath et al. | 128/397 |
| 4,572,938 | 2/1986 | Driggers et al. | 219/552 |
| 4,574,172 | 3/1986 | Burack et al. | 219/10.49 R |
| 4,621,182 | 11/1986 | Driggers | 219/553 |
| 4,631,392 | 12/1986 | O'Brien et al. | 219/549 |
| 4,699,671 | 10/1987 | Jacobs et al. | 148/13 |
| 4,714,501 | 12/1987 | Yamanaka et al. | 148/13 |

FOREIGN PATENT DOCUMENTS 2126058 3/1984 United Kingdom .

*Primary Examiner*—Upendra Roy

[57] ABSTRACT

A process for rapidly and uniformaly heat treating an Inconel® heat exchanger tube in the vicinity of a heat sink such as a support plate is disclosed herein. The process utilizes a radiant heater assembly capable of directing heat along a zone whose length is less than the length of the section of tubing to be stress relieved, and generally comprises the step of actuating the heater assembly, and oscillating it between the ends of the tube section in order to heat the tube section having nonhomogeneous thermal conductivity to a temperature that is substantially uniform along its length. The specific timing pattern used in the oscillatory movement of the heater assembly results in a substantially uniform heat gradient along the tube axis despite conductive heat losses through the support plate. The process allows heat exchanger tubes to be readily and reliably stress-relieved in the vicinity of the support plates of a nuclear steam generator.

33 Claims, 2 Drawing Sheets

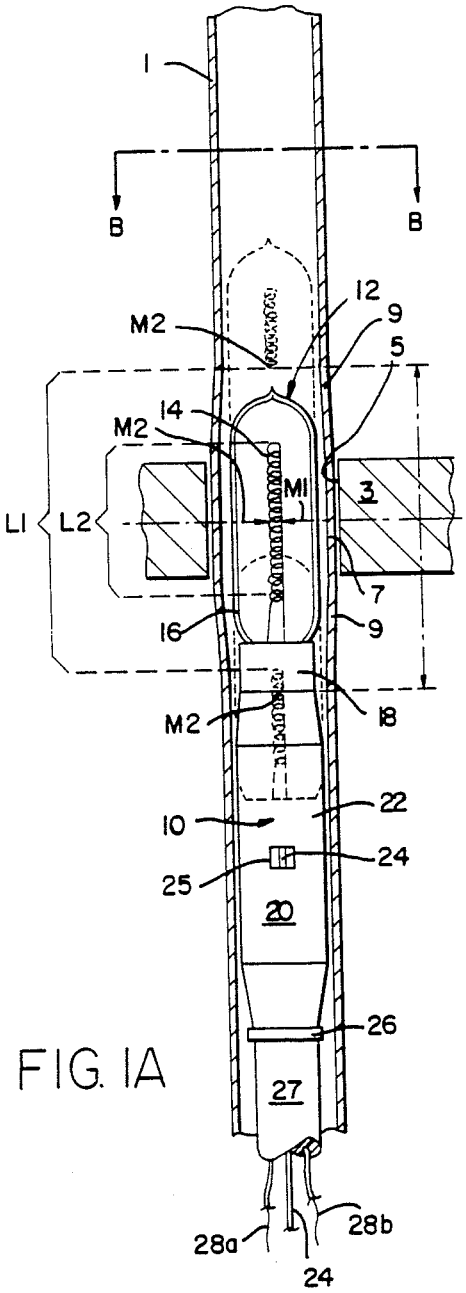
FIG. 1A
FIG. 1C
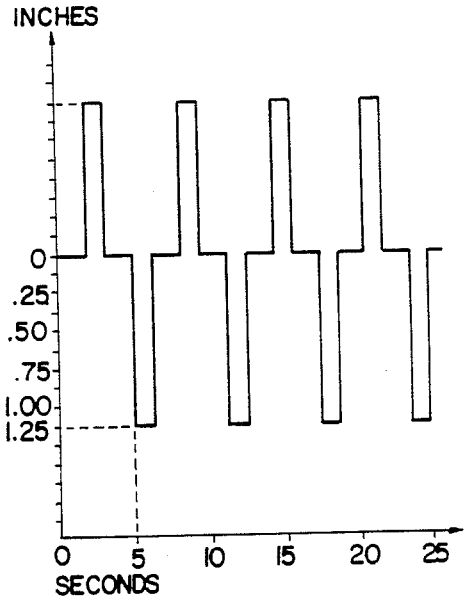
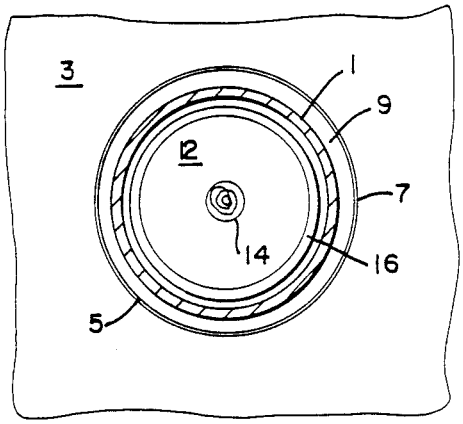
FIG. 1B

PROCESS FOR HEAT TREATING A HEAT EXCHANGER TUBE SURROUNDED BY A SUPPORT PLATE

BACKGROUND OF THE INVENTION

This invention generally relates to a process for thermally stress-relieving a metallic conduit that is surrounded in part by a heat sink, such as a section of an Inconel ® heat exchanger tube that is surrounded by a support plate in a nuclear steam generator.

Processes for thermally relieving the tensile stresses which may occur in heat exchanger tubes are known in the prior art. Such tensile stress may occur as a result of a manufacturing or maintenance operation. For example, stress causing bends are incorporated into the heat exchanger tubes used in nuclear steam generators during their manufacture in order to give them their distinctive U-shape. Stress-causing expansions are routinely induced in the sections of these heat exchanger tubes that extend through the tubesheet and support plates of the steam generator, both during the manufacture and maintenance of the generator. Finally, stress-causing welds may be placed around the interior walls of these tubes whenever reinforcing sleeves are welded therein. Other such tensile stresses may occur from the accumulation of sludge deposits in the crevice regions of the generator. The applicants have found that one of the most troublesome sources of such stresses is the sludge that accumulates in the annular region between the heat exchanger tubes and the bores in the support plates through which they extend in the steam generator. Such deposits can accumulate in these annular regions and expand to such an extent that the tube becomes dented into an ovular cross section in the support plate region.

Unfortunately, any tensile stress that is induced into the wall of such a heat exchanger tube may lead to an undesirable phenomenon known as "stress corrosion cracking" if these stresses are not relieved. However, in order to fully understand the dangers associated with such stress corrosion cracking, and the utility of the invention in preventing such cracking, some general background as to the structure, operation and maintenance of nuclear steam generators is necessary.

Nuclear steam generators are comprised of three principal parts, including a secondary side, a tubesheet, and a primary side which circulates water heated from a nuclear reactor. The secondary side of the generator includes a plurality of U-shaped heat exchanger tubes, as well as an inlet for admitting a flow of water. The inlet and outlet ends of the U-shaped tubes within the secondary side of the generator are mounted in the tubesheet that hydraulically separates the primary side of the generator from the secondary side. The primary side in turn includes a divider sheet which hydraulically isolates the inlet ends of the U-shaped tubes from the outlet ends. Hot, radioactive water flowing from the nuclear reactor is admitted into the section of the primary side containing all of the inlet ends of the U-shaped tubes. This hot, radioactive water flows through these inlets, up to the tubesheet, and circulates around the U-shaped tubes which extend within the secondary side of the generator. This water from the reactor transfers its heat through the walls of the U-shaped tubes to the nonradioactive feedwater flowing through the secondary side of the generator, thereby converting feedwater to nonradioactive steam that in turn powers the turbines of an electric generator. After the water from the reactor circulates through the U-shaped tubes, it flows back through the tubesheet, through the outlets of the U-shaped tubes, and into the outlet section of the primary side, where it is recirculated back to the nuclear reactor.

The walls of the heat exchanger tubes of such nuclear steam generators can suffer from a number of different forms of corrosion degradation, one of the most common of which is intragranular cross corrosion cracking. Empirical studies have shown that the heat exchanger tubes may be more susceptible to stress corrosion cracking whenever they acquire significant amounts of residual tensile stresses, whether deliberately induced in the manufacture or maintenance of the tube, or incidentally induced by accumulation of sludge in the crevice regions of the steam generator. If such stress corrosion cracking is not prevented, the resulting cracks in the tubes can cause the heat exchanger tubes to leak radioactive water from the primary side into the secondary side of the generator, thereby radioactively contaminating the steam produced by the steam generator.

In order to prevent such corrosion and tube cracking from occurring in the heat exchanger tubes of the generator, both mechanical and thermal stressrelieving processes have been developed. One of the most successful thermal stress-relieving processes in existence is that which is disclosed in U.S. patent application Ser. No. 24,941 filed Mar. 12, 1987 and entitled "Process for Thermally Stress Relieving a Tube" by Bruce Bevilacqua et al., assigned to the Westinghouse Electric Corporation, the entire specification of which is incorporated herein by reference. This particular process provides results in an extremely fast yet reliable process for stress relieving Inconel ® heat exchanger tubes which have had tensile stresses induced therein by bending, denting, tube expansions, or sleeve weldings.

Unfortunately, this particular prior art process is very difficult to implement along tube sections having nonhomogeneous thermal conductivity characteristics, such as the sections of the heat exchanger tubes that are surrounded by support plates. The sections of the tubes that extend through the support plates often need to be stress relieved either as a result of a deliberate tube expansion in this area, or a radial tube denting in this region caused by the accumulation of sludges in the region between the outside of the tube and the bore in the support plate which expand over time. For a detailed discussion of such radial tube denting and the maintenance expansions designed to prevent them, reference is made to U.S. Pat. No. 4,649,492 by S. Sinha et al., and assigned to the Westinghouse Electric Corporation, the entire specification of which is incorporated herein by reference. However, if one attempts to thermally stress-relieve the section of the tube extending through and in contact with such support plates in the fashion taught by the previously referred to Ser. No. 24,941 application (i.e., by means of a heater assembly that is at least as long as the tube section to be heat treated), one of two unsatisfactory results follow. Either the portion of the tube directly in contact with the support plate will be underheated due to the heat sink properties of the plate, or (if the power of the heater assembly is increased to adequately heat the plate contacting portion of the tube) the sections of the tube above and below the plate will become overheated (i.e., heated to over 1500° F.). Such overheating may cause carbides to precipitate in the grain boundaries of the Inconel® that forms the tube, thereby rendering these portions of the tube more susceptible to stress-corrosion cracking, and defeating the purpose of the thermal stress relief.

Clearly, what is needed is an improved method for thermally stress-relieving a tube which is capable of creating and maintaining a substantially uniform heat gradient across a section of a metallic tube that is characterized by nonhomogeneous thermal-loss properties. Ideally, such an improved process should be simple to implement by means of a commercially available heater assembly. Finally, it would be desirable if such a process was just as reliable and fast as previously developed thermal stress-relieving processes that are usable on sections of heat exchanger tubes having substantially homogeneous thermal loss properties.

SUMMARY OF THE INVENTION

Generally speaking, the invention is a process for heat treating a section of a metallic conduit that is surrounded along its length by a heat sink, such as an Inconel® heat exchanger tube that is surrounded by a support plate in a nuclear steam generator. In this process, a heater assembly is inserted into the open end of the conduit to be treated. The heater assembly is chosen so that its heating zone is shorter in length than the length of the conduit section being treated, but equal to or greater than the length of the heat sink surrounding the conduit. The heater assembly is actuated and oscillated between the endpoints of the conduit section in order to heat it to a substantially uniform temperature along its length until the heat treatment is completed.

The heating zone of the heater assembly may be between 100 and 200% of the length of the heat sink that surrounds a portion of the conduit section. In the first step of the process, the midpoint of the heating zone of the heater assembly is substantially aligned with the midportion of the conduit section that is surrounded by the heat sink, and the heater assembly is maintained in this position for a first time interval. At the expiration of this time interval, the heater assembly is moved so that the midpoint of its heating zone is aligned with one of the ends of the conduit section for a second time interval. Next, the heater assembly is moved back into its initial position in alignment with the midportion of the conduit section for a third time interval. At the expiration of the third time interval, the heater assembly is moved until the midsection of its heating zone is aligned with the other endpoint of the conduit section for a fourth time interval to complete a first oscillation, after which the process steps are repeated to effect subsequent oscillations.

When the conduit being treated is a section of an Inconel® heat exchanger tube that is about 2¾ inches long and surrounded at its midportion by a ¾ inch thick support plate that acts as a heat sink, the heater assembly is chosen so that its heating zone is between three-quarters and one-and-a-half inches in length. Additionally, the time interval when the heating zone of the heater is aligned with the midportion of the tube surrounded by the support plate is substantially longer than the time intervals associated with the upper and lower limits of the oscillation. In a preferred embodiment of the process, the first and third time intervals (wherein the heating zone of the heater assembly is substantially aligned with the midportion of the tube section) are approximately two seconds long, while the second and fourth time intervals (wherein the heating zone is aligned with the ends of the tube section) are only about one second long apiece. Additionally, the length of the tube section is selected so as to include all of the tubing between about one inch above and one inch below the midposition of the surrounding support plate. The entire process preferably takes between about six and eight minutes.

The process of the invention allows a section of Inconel® tubing surrounded by a support plate to be heated to a temperature that is substantially uniform throughout the tube section and which is capable of thermally stress-relieving the tube in the vicinity of the support plate without overheating any portion of the tube.

BRIEF DESCRIPTION OF THE SEVERAL FIGURES

FIG. 1A is a cross-sectional side view of a section of a heat exchanger tube in a nuclear steam generator which is being heat treated by a heater assembly formed from a tungsten halogen quartz lamp in accordance with the process of the invention;

FIG. 1B is a top view of the heat exchanger tube illustrated in FIG. 1A along the line B—B;

Figure 2:
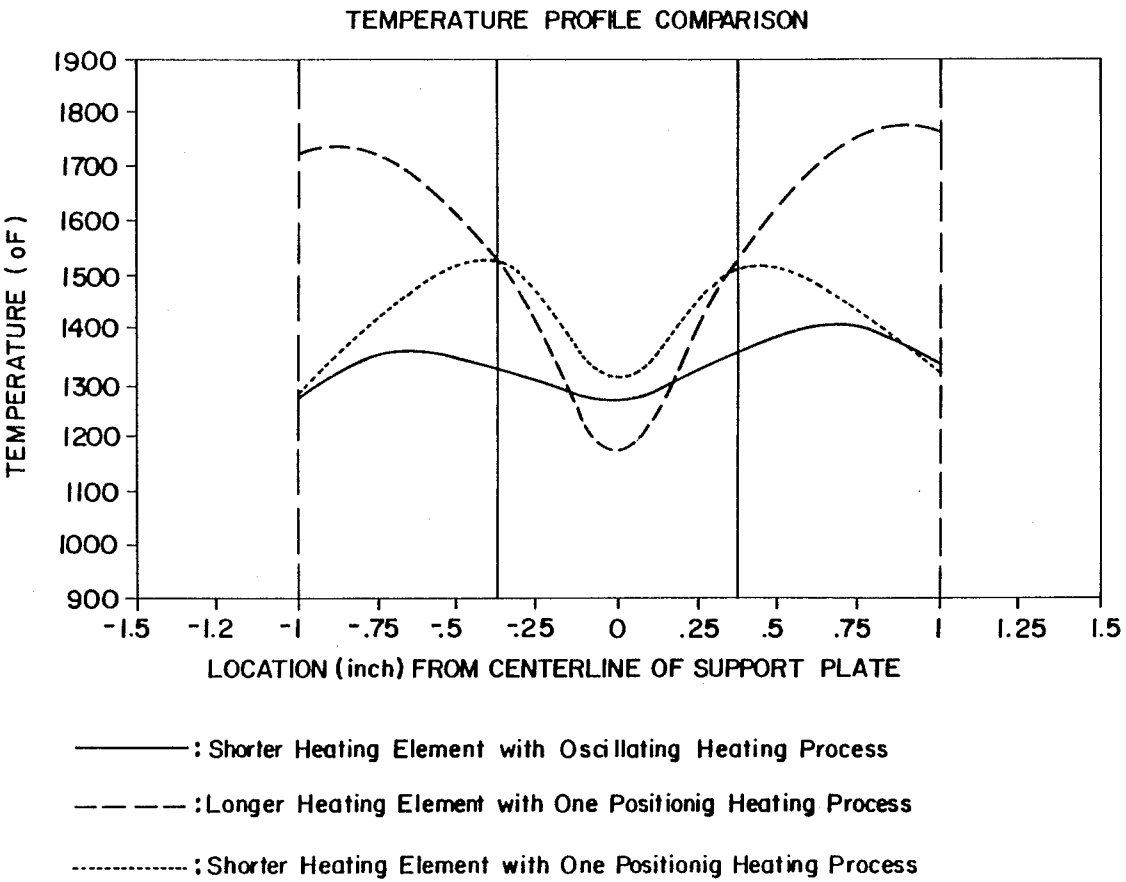

FIG. 1C is a time-distance graph whose distance axis is juxtaposed over the center line of the support plate which illustrates both the axial amplitude and periodicity of the oscillations that the heater assembly is subjected to when implementing the process of the invention, and FIG. 2 are comparative temperature profiles illustrating the temperature profile of the tube section illustrated in FIG. 1 along its longitudinal axis that is obtainable with the oscillating process of the invention (see solid line) versus the temperature profiles obtainable with stationary heater assemblies utilizing heating elements which are either longer or shorter than the tube length being treated (see dashed and dotted lines, respectively).

DETAILED DESCRIPTION OF THE PREFERRED EMBODIMENT OF THE INVENTION

With reference to FIGS. 1A and 1B, wherein like numeral designate like components throughout all of the several figures, the heat treating process of the invention is particularly adapted for thermally stress-relieving a section of a heat exchanger tube 1 having a length L1 whose middle portion has been radially expanded in the vicinity of a support plate 3. As has been previously mentioned, such expansions are routinely carried out by means of a hydraulic mandrel (not shown) in order to eliminate the annular clearance between the outer walls of the tube 1, and the bore 5 which conducts the tube 1 through the support plate 3. Such tube expansions typically create a cylindrically shaped expanded section 7 in the tube that abuts the bore 5 of the support plate 3. This cylindrically shaped section 7 is flanked by upper and lower frustoconically shaped transition sections 9. The principal purpose of the process of this invention is to relieve the residual tensile stresses which are created in the tube section throughout its length L1 which encompasses the expanded 7 and transition sections 9 of the tube 3. However, to accomplish this, the conduit section must be uniformly heated throughout its length L1 despite the presence of a substantial heat sink in the middle portion of the tube section in the form of the carbon steel support plate 3.

The process of the invention is preferably carried out by means of a heater assembly 10 formed from a commercially available incandescent bulb 12. In the preferred embodiment, the bulb 12 is a Sylvania model 1000-Q/3CL tungsten halogen bulb. Such bulbs 12 include a 16-coil tungsten filament 14 encased within a quartz envelope 16. The base 18 of the bulb 12 is secured onto a ceramic connector assembly 20 having an enlarged, cylindrical base 22 whose outer diameter is closely dimensioned to the inner diameter of the tube 1. Such dimensioning allows the cylindrical base 22 of the connector assembly 20 to concentrically center the filament 14 of the bulb 12 along the longitudinal axis of the tube 1, thereby ensuring a uniform distribution of radiant energy around the circumference of the tube 1. The cylindrical base 22 may house an optical fiber 24 whose proximal end is exposed to the interior walls of the tube 1 through a radially oriented window 25. The proximal end of the optical fiber 24 is preferably optically connected to a two-color pyrometer (not shown). The provision of such an optical fiber 24 in the cylindrical base 22 of the connector assembly 20 provides the heater assembly 10 with a means for measuring the temperature of the walls of the tube 1 should such measurements be desired. The optical fiber 24, radial window 25 and pyrometer may be selected in accordance with the specification of U.S. application Ser. No. 720,105 filed Apr. 4, 1985 by John M. Driggers et al. and assigned to Westinghouse Electric Corporation. Circumscribing the cylindrical base 22 is an eddy current probe 26 which helps the operator to properly position the heater assembly 10 with respect to the tube length L1. The proximal end of the cylindrical base 22 is in turn connected onto a plush rod 27 whose other end (not shown) is manipulated by the operator of the heater assembly 10 to slidably oscillate the bulb 12 along the length L1 of the tube 1. The push rod 27 houses both the previously mentioned optical fiber 24, as well as the lead wires 28*a*, 28*b* of the bulb 12. In the preferred embodiment, the bulb lead wires 28*a*, 28*b* are connected to a variable source of electrical power (now shown) so that the bulb 12 may be operated at a power level less than its 1000 watt capacity.

In operation, the heater assembly 10 generates an effective heating zone whose length L2 is approximately the same as the length of the 16-coil tungsten filament 14 of the bulb 12. However, it should be noted that the midpoint of the heating zone L2 is not located at exactly the midpoint of the filament 14; rather, the midpoint of this zone L2 corresponds to approximately the seventh coil of the filament 14 as counted from the top of the filament. This disparity between the midpoint of the heating zone L2 and the midpoint of the filament 14 is a consequence of the convection currents in the surrounding air generated by the bulb 12, which tends to skew the heat gradient associated with the heating zone L2 upwardly. Of course, the precise limits of the heating zone are not confined exclusively within the length L2. But, since the temperature gradient of the heating zone rapidly diminishes on either side of the length L2, we shall ignore the heating effects generated by the bulb 12 beyond the length L2.

In the first step of the heat treating process, the operator slides the heater assembly 10 through the open end of the tube 1 which is mounted in the tubesheet (not shown) of the generator. He then proceeds to position the midpoint M2 of the heating zone L2 with the midline M1 of the support plate 3. This may be accomplished by using the previously described eddy current probe 26 in the manner specifically set forth in U.S. patent application Ser. No. 615,868 filed May 31, 1984 entitled "Process for Accurately Determining Plate Positions in Steam Generators" by John M. Driggers and assigned to the Westinghouse Electric Corporation.

Once the heating zone L2 associated with the bulb 12 has been centrally positioned with respect to the midline M1 of the support plate 3, the bulb 12 is actuated by connecting the leads 28*a*, 28*b* with a source of electrical power (not shown), In the preferred process of the invention, the bulb 12 is operated at only approximately 750 watts, instead of its 1000 watt maximum capacity. The applicant believes that the use of a somewhat lower power level than the 1000 watt capacity of the bulb 12 helps to effect a more uniform temperature profile along the length L1 of the tube section without any substantial increase in the time period necessary to complete the heat treatment process. It further has the advantageous effect of increasing bulb life.

The bulb 12 is held in midpoint alignment as previously described for a time period of approximately two seconds. Then the heater assembly 1 is moved along the longitudinal axis of the tube 1 in accordance with the time-amplitude pattern illustrated in the graph of FIG. 1C. Specifically, the operator slides the bulb 12 upwardly one inch, and waits for approximately one second, whereupon the slides the bulb 12 back down into the position illustrated in FIG. 1A for approximately two seconds again. Next, the operator slides the bulb 12 downwardly approximately one and one-eighth inches for a time period of one second. Afterwards, the operator slides the bulb 12 back into the midpoint alignment position illustrated in FIG. 1A for two seconds, whereupon the oscillation pattern is repeated.

The previously described oscillation pattern results in the rhythmic alignment of the midpoint of the heating zone L2 first with the midline of the support plate 3, and next with the upward limit of the length L1 of the tube section, and then with the midpoint of the support plate 3 again, and finally with the lower limit of the length L1 of the tube section. It should be noted that the alignment of the midpoint of the heating zone L2 (rather than just the upper or lower limit of the heating zone L2) with the upper and lower limits of the tube length L1 results in the heat treatment of a length of the tube 1 which is in fact greater than the length L1 of the tube section. This characteristic of the inventive process advantageously ensures that the expanded length L1 of the tube 1 will be thermally stress-relieved even in instances where the operator fails to achieve a perfect midpoint alignment between the heating zone L2 and the expanded length L1 of the tube. It further ensures that the smaller (but still significant) tensile stresses induced in the tube 1 beyond the boundaries of the expanded sections 7 and 9 within the length L1 will also be relieved.

Still another characteristic of the inventive process is the fact that the lower amplitude of the oscillations is one-eighth of an inch greater than the upper amplitude of these oscillations. This characteristics advantageously compensates for the skewing of the heating zone L2 which results from the rising convective air currents generated by the bulb 12 during operation. A further characteristic of the inventive process is the fact that the dwell time at the support plate midpoint alignment position is twice as great as the combined dwell times at either end of the expanded length L1 of the tube 1. The applicant has found such apportionment of dwell times substantially compensates for the conductive heat losses which occur around expanded section 7 of the tube 1 in contact with the support plate 3.

The previously described oscillating pattern of the heater assembly 10 should be continued for approximately six to eight minutes, of which about 2 minutes is the ramp time needed to attain a stable heat gradient in tube length L1 of between about 1350° to 1450° F., and of which about four to six minutes is the soak time necessary to complete the heat treatment. The advantage resulting from the attainment of such time and temperature parameters are specifically set forth in U.S. application Ser. No. 24,941 filed Mar. 12, 1987 by Bruce Bevilacqua et al. and assigned to the Westinghouse Electric Corporation.

An exemplary profile which results from the use of the foregoing process across an expanded tube section of length L1 is illustrated in FIG. 2 by the solid line. The minimum temperature along this profile is approximately 1275°, whereas the maximum temperature is approximately 1425° F. Contrast this temperature profile with the profile obtained with the use of a stationary heater assembly having a heating element approximately the same length as the length L1 of the tube section to be heat treated (designated by the dash line), or the heat profile obtained with the use of a stationary heater assembly having a heating element substantially shorter than the tube length L1 to be heat treated, such as the heater assembly 10 illustrated in FIG. 1A (see the graph indicated by the dotted line). As the dash line indicates, the temperature profile achieved with the first type of stationary heater assembly ranges from about 1175° F. to 1775° F., which indicates a clear overheating of the region of the tube 1 above the plate 3. As is shown by the dotted line, the temperature profile achieved with the second type of stationary heater assembly ranges from about 1520° F. to 1275° F., again indicating an overheating of the region of the tube 1 at the boundaries of the support plate 3. Hence, it is clear that the oscillation of a heater assembly having a heater element that is shorter than the section of tube being treated results in a substantially more compressed temperature profile which neither overheats or underheats any portion of the tube section.

We claim:

1. A process for heat treating a section of metallic conduit with a heater assembly in order to relieve tensile stresses in the conduit, wherein said conduit section is surrounded along part of its length by a heat sink, and said heater assembly radiates heat along a zone whose length is less than the length of the conduit section, comprising the step of slidably moving the heater assembly within said conduit so that the heat zone is oscillated between the ends of the conduit section in order to heat the conduit section to a substantially uniform temperature until said heat treatment is completed.

2. The process of claim 1, wherein the heat sink is symmetrically disposed around the midpoint of the conduit section.

3. The process of claim 1, wherein a central portion of the heat zone of the heater assembly is first positioned adjacent to the midline of the heat sink for a first time interval, and then positioned adjacent to one end of the conduit section for a second time interval, and again positioned adjacent to the midline of the heat sink for a third time interval, and finally positioned adjacent to the other end of the conduit section for a fourth time interval.

4. The process of claim 1, wherein the length of the heating zone of the heater assembly is at least about equal to the length of the section of the conduit directly adjacent to the heat sink.

5. The process of claim 1, wherein the length of the heat sink is between about 30 and 50 percent of the length of the conduit section.

6. The process of claim 1, wherein said conduit is substantially vertically oriented, and the heat gradient of the heating zone of the heater assembly is upwardly skewed with respect to the heater assembly, and the amplitude of the downward oscillation is greater than the amplitude of the upward oscillation relative to the midline of the heat sink in order to compensate for the assymmetrical heat gradient of the heating zone of the heater assembly.

7. The process of claim 3, wherein said first and third time intervals are substantially equal, and second and fourth time intervals are substantially equal.

8. The process of claim 6, wherein said first and third time intervals are about two seconds, and said second and fourth time intervals are about one second.

9. The process of claim 7, wherein said first time interval is substantially twice the same as the second and fourth time intervals.

10. A process for heat treating an expanded section of an Inconel ® tube by means of a heater assembly that is insertable within said tube in order to relieve tensile stresses in the tube section, wherein a portion of the expanded section of said tube is surrounded by a metallic plate that acts as a heat sink, and wherein the heater assembly radiates heat along a zone whose length is less than the length of the expanded section of the tube being treated, comprising the step of sliding the heater assembly back and fourth so that the midpoint of the heating zone radiated thereby is oscillated between the ends of the expanded section in order to heat the expanded tube section to a substantially uniform temperature along is length until the heat treatment is completed.

11. The process of claim 10, wherein the midpoint of the heating zone of the heater assembly is first positioned adjacent to the midportion of the expanded tube section for the first time interval, and then positioned adjacent to one end of the tube section for a second time interval, and then positioned back adjacent to the midportion of the tube section, and finally positioned adjacent to the other end of the tube section for a fourth time interval.

12. The process of claim 10, wherein the expanded tube section is between about 2½ and 3 inches in length.

13. The process of claim 10, wherein the length of the heating zone of the heater assembly is substantially the same as the length of the portion of the expanded tube section that is surrounded by the heat sink.

14. The process of claim 11, wherein the length of the heating zone of the heater assembly is about half the length of the expanded tube section.

15. The process of claim 12, wherein the length of the heating zone of the heater assembly is between about ¾ and 1½ inches.

16. The process of claim 14, wherein the length of the metallic plate along the longitudinal axis of the tube is between about 30 and 50 percent of the length of the expanded tube section.

17. The process of claim 16, wherein said first and third time intervals are about two seconds apiece, and said second and fourth time intervals and about one second apiece.

18. A process for heat treating a section of a tube formed from an alloy that includes nickel and chromium by means of a heater assembly that is insertable within the tube in order to relieve tensile stresses in the tube section, wherein a portion of the tube section is surrounded by a heat sink, and wherein the length of the heating zone of the heater assembly is between about 100 to 150% of the length of the portion of the tube section that is surrounded by the heat sink, comprising the step of sliding the heater assembly back and forth so that the heating zone radiated thereby is oscillated between the ends of the tube section in order to heat the tube section to a substantially uniform temperature along its length until the heat treatment is completed.

19. The process of claim 18, wherein the midpoint of the heating zone of the heater assembly is positioned adjacent to the midline of the heat sink and then adjacent to one end of the tube section and then back adjacent to the midline of the heat sink, and finally adjacent to the other end of the tube section for first, second, third and fourth time intervals, respectively.

20. The process of claim 18, wherein the heat sink is a metallic plate between one-half and one inch in thickness that surrounds the midportion of the tube section.

21. The process of claim 18, wherein the heater assembly heats the tube section to between 1250° and 1500° F. for between four and six minutes.

22. The process of claim 18, wherein the power capacity of the heater assembly is between 700 and 1000 watts.

23. The process of claim 19, wherein the first time interval is about twice as long as the second and fourth time intervals.

24. The process of claim 19, wherein the first and third time intervals are about two seconds each, and the second and fourth time intervals are about one second each.

25. The process of claim 20, wherein the tube section extends about one inch above and one inch below the upper and lower surfaces of the plate.

26. The process of claim 22, wherein the heater assembly is a tungsten halogen quartz lamp having a heating element about one inch in length.

27. A process for uniformly heat treating a section of a heat exchanger tube formed from Inconel® and having an open end in order to relieve tensile stresses in the tube section, wherein the midportion of the tube section is surrounded by a support plate that acts as a heat sink when said tube section is heated, comprising the steps of:

(a) inserting a radiant heater assembly having a heating zone whose length is less than the length of the tube section into said tube;

(b) actuating said radiant heater assembly, and oscillating the radiant heater within said tube section by (i) aligning the midpoint of the heating zone of the heater assembly with the midpoint of the midportion of the tube section for a first time interval;

(ii) aligning the midpoint of said heating zone with an endpoint of the tube section for a second time interval that is shorter than said first time interval;

(iii) aligning the midpoint of said heating zone with the midpoint of the midportion of the tube section for a third time interval;

(iv) aligning the midpoint of said heating zone with the other endpoint of the tube section for a fourth time interval that is substantially equal to the second time interval, and (v) repeating steps i-iii until the heat treatment of said tube section is completed.

28. The process of claim 27, wherein the first time interval is about two seconds.

29. The process of claim 28, wherein the tube section is between about 2 and 3 inches in length.

30. The process of claim 28, wherein the second and fourth time intervals are about one second each.

31. The process of claim 29, wherein the heating zone of the heater assembly is between about $\frac{3}{4}$ and $1\frac{1}{2}$ inches.

32. A process for uniformly heat treating a section of a heat exchanger tube formed from Inconel® in a steam generator and having an open end in order to relieve tensile stresses therein, wherein the midline of the tube section is symmetrically surrounded by a support plate that acts as a heat sink when said tube section is heated, comprising the steps of (a) inserting a radiant heater assembly into said tube which has an effective heating zone whose length is between about three-quarters and one-and-one half inches;

(b) actuating said radiant heater assembly, and oscillating the radiant heater between opposing endpoints of the tube section by:

(i) aligning the midpoint of the heating zone of the heater assembly with the midline of the tube section for about two seconds;

(ii) aligning the midpoint of the heating zone of the heater assembly with an endpoint of the tube section for about two seconds;

(iii) aligning the midpoint of the heating zone again with the midline of the tube section for about two seconds;

(iv) aligning the midpoint of the heating zone with the other endpoint of the tube section for about one second; and (v) repeating steps i through iv until the heat treatment of the tube section is completed.

33. A process for heat treating an elongated expanded section of a heat exchanger tube in a nuclear steam generator formed of Inconel® 600 that is surrounded at its midportion by a support plate by means of a heater assembly that emanates heat along a zone that is shorter than the length of the expanded tube section but at least as long as the thickness of the support plate, comprising the steps of:

(a) inserting the heater assembly within the tube and actuating it, and (b) oscillating the heater assembly so that the middle portion of the heat zone emanated thereby is lid back and forth between the opposite endpoints of the expanded tube section in such a manner that the heat zone spends approximately twice as much time aligned with the midportion of the tube section than at the opposing endpoints of said section in order to heat said expanded tube section to temperatures of between 1200 degrees F to 1400 degrees F at each point along its longitudinal axis.

* * * * *